United States Patent [19]

Gics

[11] Patent Number: 4,629,847

[45] Date of Patent: Dec. 16, 1986

[54] RESONATOR DEVICE FOR A MICROWAVE HEAT APPLICATOR

[76] Inventor: Paul W. Gics, 92 Merriman Rd., Sewickley Hights, Pa. 15143

[21] Appl. No.: 795,784

[22] Filed: Nov. 7, 1985

[51] Int. Cl.[4] ..... H05B 6/70

[52] U.S. Cl. ..... 219/10.55 A; 219/10.55 F; 34/1; 333/230; 333/248

[58] Field of Search ..... 219/10.55 A, 10.55 F, 219/10.55 R, 10.55 D, 10.55 E, 10.55 M; 333/22 F, 22 R, 248, 230, 239, 113, 114; 34/1

[56] References Cited

U.S. PATENT DOCUMENTS

| | | | |
|---|---|---|---|
| 2,833,993 | 5/1958 | Riblet | 333/113 |
| 3,672,066 | 6/1972 | Stephansen | 34/1 |
| 3,740,515 | 6/1973 | Vankoughnett | 219/10.55 A |
| 3,999,026 | 12/1976 | Böling | 219/10.55 F X |

FOREIGN PATENT DOCUMENTS

| | | | |
|---|---|---|---|
| 1277427 | 6/1972 | United Kingdom | 219/10.55 A |

*Primary Examiner*—Philip H. Leung
*Attorney, Agent, or Firm*—Lawrence Hager

[57] ABSTRACT

The microwave power head or modular heat applicating unit comprising a resonator, a waveguide, a source of microwave energy and a water load device. The resonator is divided into two chambers by a center wall member. A microwave energy receiving antenna means is operatively connected to the center wall for coupling microwave energy into the resonator. A microwave energy transmitting antenna spaced from said receiving antenna is operatively connected to the center wall for transmitting microwave energy from the resonator to a water load. In this manner, the resonator provides a dual function.

10 Claims, 5 Drawing Figures

RESONATOR DEVICE FOR A MICROWAVE HEAT APPLICATOR

FIELD OF THE INVENTION

The present invention relates to a heating device which is fed with microwave energy and, more particularly, to a dual antenna system resonator for heat sealing thermoplastic layers, packagings of paper or cardboard and the like.

PRIOR ART STATEMENT

Various types of microwave ovens and applicators have hitherto been proposed.

Typically, the prior art microwave heating devices used in the food packaging industry comprised a microwave energy source or magnetron positioned remote from the heat applicating resonator and a circulator device affixed within a waveguide for directing reflected-back energy to an elongate test tube like glass dummy load.

The present applicant discovered that the prior art devices when utilized for sealing packages, for example containing food, under a mass production environment, present costly time delays and difficulties to effect repairs and/or replacement of these devices. The cost factors involved are exacerbated due to the fact that the packaging/processing line is typically shutdown during the repair or replacement operation. Another serious disadvantage of the prior art units is the use of a circulator device which is relatively expensive and may require periodic adjustment or maintenance resulting in the above noted shutdown delays.

Some prior art patents of interest include U.S. Pat. Nos. 3,999,026 issued Dec. 21, 1976 to Göran Böling; 4,160,145 issued July 3, 1979 to Werner Rudggeberg; 4,295,908 issued Oct. 20, 1981 to Hans G. Schaefer et al; 4,188,769 issued Feb. 19, 1980 to Marvin L. Bright, Jr.; 3,293,765 issued Dec. 27, 1966 to R. Winkler et al; 3,518,396 issued June 30, 1970 to T. L. Wilson et al; and 4,276,462 issued June 30, 1981 to Per O. Risman.

These patents are mentioned as being representative of the prior art and other pertinent references may exist. None of the above cited patents are deemed to affect the patentability of the present claimed invention.

The present invention involves a novel combination of features combined in such a way as to afford a solution to the difficulties and problems encountered with the prior art.

For example, in contrast to the prior art, the present invention provides a microwave resonator device having a microwave energy receiving antenna and a microwave energy transmitting antenna. The transmitting antenna couples microwave energy, during periods when no packages are being sealed to a dummy load thereby obviating need for a relatively expensive circulator device.

SUMMARY OF THE INVENTION

A dual function microwave energy resonator and transmission device having particular utility for heat sealing food packagings or containers in a mass production environment, in combination comprising:

resonator means (11) having an elongate rectangular configuration with an elongate slot (75), and having an elongate upper wall member (15) being readily attachable in elongate juxtaposition to said bottom wall of the waveguide, said upper wall member having a pair of spaced apart antenna receiving holes (23,27) each being aligned with a respective second and third antenna hole within said waveguide, said resonator being divided into at least two chambers by an elongate metal wall (20) supported along one edge by said upper wall member (15), said elongate metal wall having a pair of spaced apart V-shaped notches (22,26) each being aligned with a respective antenna receiving hole (35,36), a receiving antenna (21) for receiving microwave energy from said transmitting antenna (45) and a resonator transmitting antenna (24) for transmitting microwave energy to the dummy load (14), with each antenna 21 and 24 being affixed at one end to a portion of a respective V-shaped notch with its other end projection within the interior cavity of said waveguide, each of said pair of antennae (21,24) has a coating of resins or other suitable material to function as a gasket and arc preventor means and effecting a snugfit about the respective second and third antenna holes within said waveguide;

whereby said resonator provides a duel function, VIZ: as a heat generating resonator and as a transmission means to the dummy load to dissipate excess energy.

Accordingly, it is an object of the present invention to provide a new and improved heating device fed with microwave energy.

It is a further object of the present invention to provide a microwave system having a dual function resonsator.

It is a further object of the present invention to provide microwave energy system for sealing containers under mass production requirements.

It is a further object of the present invention to provide a microwave resonator having a plurality of antennae such that the resonator functions as a resonating chamber and as a transmission line or means.

It is a further object of the present invention to provide a relatively inexpensive means to manufacture unitary structure resonator.

BRIEF DESCRIPTION OF THE DRAWINGS

Other objects and advantages of the present invention will be evident from the following detailed description when read inconjunction with the accompanying drawings which illustrate the preferred embodiment of the present invention. Similar reference numerals refer to similar parts throughout.

DESCRIPTION OF THE PREFERRED EMBODIMENT

Figure 5:
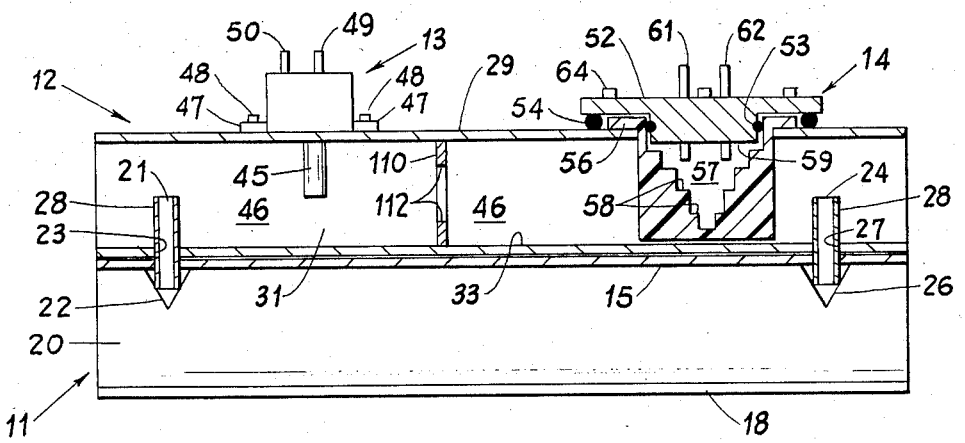
FIG. 5 is a longitudinal sectional view of the microwave power head illustrated in FIG. 4 taken along line A—A.

Reference will now be made to the drawings, and in particular to FIG. 5 in which there is shown an exploded view of the microwave power head 10. Basically speaking, the microwave power head 10 comprises a resonator 11, a waveguide 12, a source of microwave energy 13, and a dummy load container device 14.

The resonator 11 has a generally elongate rectangular configuration comprising a top wall 15, side walls 16 and 17, two partial walls 18 and 19, and a center wall or hot-tongue member 20. The center wall 20 basically divides the resonator 11 into two chambers and is affixed in an upright manner to top wall 15 or is formed integrally as a downwardly projecting wall portion.

The microwave energy is coupled into the resonator by means of a receiving antenna 21. The receiving antenna 21 is connected to a V-shaped slot 22 (ss FIG. 5) in the center wall 20, and projects upwardly through an opening 23 in top wall 15.

A second antenna 24 is connected to V-shaped slot 26 in center wall 20, and also projects upwardly through an opening 27 in top wall 15.

Each antenna 21 and 24 is coated with a protective shield 28 such as plastic or synthetic flourine containing resins to function as a gasket and arc suppressor.

Waveguide 12 has an elongate rectangular configuration comprising top wall 29, bottom wall 30, side walls 31 and 32, and end walls 33 and 34. Bottom wall 30 has a pair of spaced apart holes 35 and 36 each dimensioned and located for receiving antenna 21 and 24, respectively. Antennae 21 and 24 and/or their respective plastic coatings may be tapered to facilitate insertion into its respective receiving hole 35 and 36. The diameter of antenna 21 and 24 with its plastic coating is dimensioned and configured to effect a snug fit within its respective receiving hole 35 and 36, with the power head 10 being in the assembled state (see FIGS. 4 and 5). Top wall 29 has an antenna receiving hole 37 and a dummy load receiving hole 38. The width 39 of waveguide 12 is approximately equal to the width 40 of resonator 11. A pair of alignment pins 41 and 42 project downwardly from bottom wall 30 and are positioned for being received within an alignment hole 43 and 44, respectively, within top wall 15 of resonator 11. The alignment pins 41 and 42 serve a dual function of facilitating assembly and of providing protection to antennae 21 and 24 against any sheering disposition between resonator 11 and waveguide 12.

Partition wall 110 (shown in phantom outline in FIG. 1) is provided within waveguide 12 intermediate between transmitting antenna 45 and dummy load device 14. Partition wall 110 has a generally center energy passage window 111. The wall portions 112 defining window 111 may be tapered to have a first opening facing transmitting antenna 45 and a second opening facing receptacle member 55. Said first opening being of greater size that said second opening. The side of said first and second openings of window 111 and, therefore, the slope of tapered or contoured walls 112 may be determined empirically to effect best operating results. The purpose of partition wall 110 is to provide a microwave energy block to substantially prevent the microwave energy transmitted by antenna 45 from traveling along waveguide 12 to dummy load 14 during periods when the resonator 11 is being utilized to heat a package (not shown) etc., i.e., with thermoplastic layers being inserted between walls 18 and 19 of resonator 11. During such periods the dimension and/or tapering of window 111 relative to the (loaded) frequency and strength of the microwave energy is such that virtually no or relatively little leakage microwave energy is coupled, via window 111, to dummy load 14. However, during unloaded periods of operation of resonator 11, i.e., no package is being heat sealed, the (unloaded) frequency and/or strength of the microwave energy within waveguide chamber 46 is relative to the dimension and configuration of window 111, to effect a substantial energy (leakage) path, via window 111 and waveguide chamber 46, to the dummy load 14 to enhance unwanted energy dissipation.

The source of microwave energy or magnetron 13 may be of conventional design and has a transmitting antenna 45 dimensioned for being inserted within hole 37 of waveguide 12 such that it projects within cavity 46 of waveguide 12. Magnetron 13 may be mounted to waveguide 12 in conventional manner, for example, by means of mounting brackets 47, bolts 48 and bolt receiving holes 49 in waveguide 12. Magnetron 13 has a fluid inlet and outlet port 50 and 9 to enable fluid (water) cooling of the magnetron 13 in conventional manner.

The dummy load device 14 comprises a cup or jar shaped container 51, a cover member 52, a first O-ring gasket 53 and a second O-ring gasket 54. Container 51 has a downwardly extending circular fluid (water) receptacle member 55 and a circular upper ledge member 56. Receptacle member 55 has an interior cavity 57 defined by a plurality of circular wall portions 58 of decreasing diameter from top to bottom to effect a sloping or stepped interior wall surface. In this manner, a fluid dummy load, for example, water, having a sloping surface may be presented to an electrical field within waveguide cavity 46. The outer diameter of receptacle member 55 is dimensioned to fit into waveguide hole 38. Ledge member 56 is dimensioned to extend beyond the surface portions of waveguide 12 defining hole 38 and for abutting atop waveguide wall 29. In this manner, receptacle member 55 may be readily inserted into and removed from waveguide hole 38. Receptacle member 55 may be formed of any suitable material such as plastic, glass or various resins. O-ring 53 may be of conventional design and construction having an outer diameter slightly greater than the diameter of the lower cap member 59 (see FIG. 5) of cover member 52. Cover member 52 has a generally circular plate shape with a downwardly projecting cap member 59. Cap member 59 has a circumferential notch 60 for receiving O-ring 53. Cover member 52 may be formed of any suitable metal such as aluminum. An inlet and outlet port 61 and 62 are provided to enable the circulation of coolant, for example, water, to be pumped (not shown) into and out of receptacle member 55. O-ring 54 has an inner diameter greater than the diameter of ledge member 56 of dummy load device 51 and less than the diameter of cover member 52. O-ring 54 may include metallic strands to form a shield to prevent or substantially reduce any microwave energy leakage above the dummy load device 14.

Figure 4:
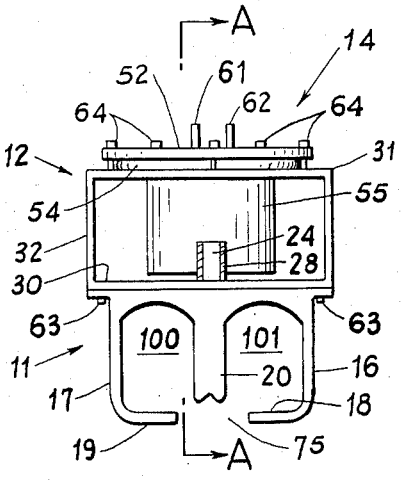
FIG. 4 is an end view, with its end wall member removed, of the microwave power head illustrated in FIG. 1 in the assembled state.

With particular reference now to FIG. 4, an end view of the assembled microwave power head 10 is shown with end wall 33 removed. Waveguide 12 is placed in longitudinal alignment atop resonator 11. Waveguide 12 may be clamped or affixed to resonator 11 by any conventional means such as bolts 63 or a toggle clamp means (not shown). The ledge member 56 is placed in abutment atop wall 29 of waveguide 12. Cover member 52 is placed over ledge member 56 and is clamped or affixed to waveguide 12 by a plurality of bolts 64 and mating holes 65 and 66, or other suitable conventional means. O-ring 54 is compressed between cover member 52 and top wall member 29 of waveguide 12.

With particular reference now to FIG. 5, a cross sectional view of the microwave power head assembly 10 is illustrated. As noted above, receptacle member 55 extends within waveguide cavity 46. The interior surface of receptacle member 55 is stepped 58. With cover member 52 affixed to waveguide 11 as shown, cap member 59 fits within the upper opening 67 of cavity 57. O-ring 53 fits between notch 60 and the circumferential walls forming opening 67. O-ring 53 forms a seal between receptacle member 55 and cover member 52. O-ring 54 is formed of conventional material to effect a shielding about ledge member 56 with being compressed between waveguide wall 29 and cover member 52.

Figures 1, 2, 3:
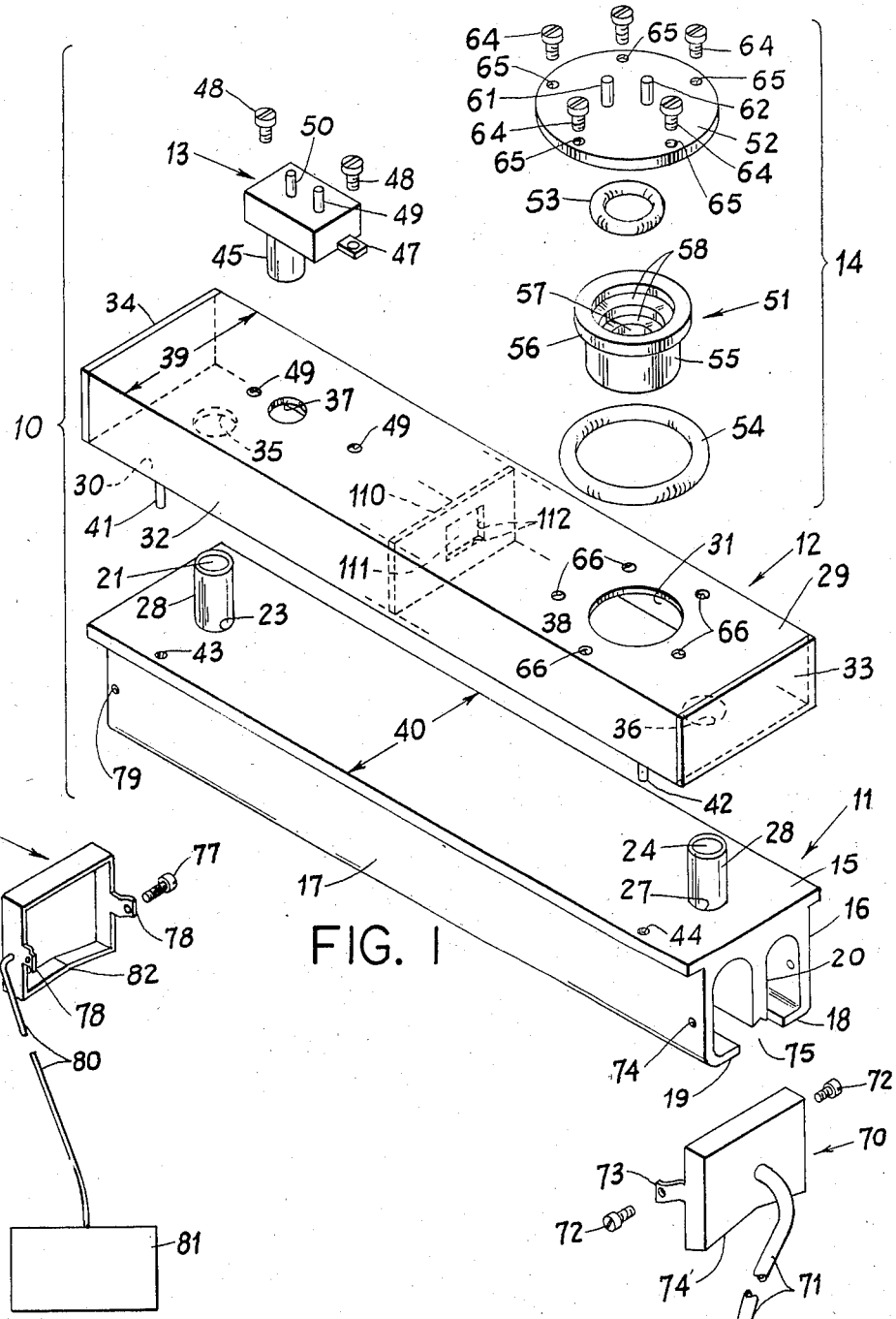
FIG. 1 is an exploded view, partly in phantom, of the mirowave power head in accordance with the invention.
FIG. 2 is a diagrammatic illustration of a vacuum device attachment for the microwave power head.
FIG. 3 is a diagrammatic illustration of a spray attachment for the microwave power head.

With reference now to FIGS. 2 and 3, additional (optional) attachments to assembly/system 10 are illustrated. End spray attachment 70 comprises a fluid or cleansing liquid spray nozzle (not shown). The spray nozzle is operatively connected, via tubing or hoses 71, to a source of water 72 and/or other suitable cleansing solution. Spray attachment 70 may be mounted in juxtaposition at a first end of resonator 11 by conventional means such as bolt(s) 72 and brackets 73 and mating hole(s) 74. The spray nozzle directs the cleansing solution into and longitudinally through resonator 11 for cleaning debris from the wall surfaces thereof. The bottom surface 74 of spray attachment 70 may be contoured to aid or facililtate guide food container edges etc. to be heat sealed into the longitudinal slot 75 of resonator 11.

A vacuum device 76 may be mounted, for example, by means of bolts 77, brackets 78 and mating holes 79. Vacuum device 76 is connected, via hose 80 to a vacuum or suction pump 81. The bottom surface 82 of vacuum device 76 may be contoured to substantially prevent jamming of the sealed package (not shown) at the exiting or end section of resonator 11.

With spray attachment 70-72 and vacuum device 76,81 being selectively/periodically activated, resonator 11 may be washed/sprayed and any resulting debris substantially removed by vacuum device 76. Of course, the cleaning operation is effected when the resonator 11 is deengergized or the sealing operation is interrupted.

It is particularly pointed out at this time, in accordance with the invention, that the resonator housing comprising walls 15, 16, 17,18,19 and 20 may be integrally formed out of a piece of metal, for example, aluminum, stock by conventional means such as drilling out resonator chambers 100 and 101 and cutting open slot 75, or by other machine tooling method. In this manner, resonator 11 may be relatively inexpensively manufactured.

OPERATION

The operation and dual function of the resonator 11 will now be described in detail with reference to the drawings.

For ease of understanding, it will be assumed that the microwave power head is operatively connected and set-up (not shown) in a (food) packaging and sealing system whereby, for example, food containers and the like are automatically transported such that their protruding ledge like (thermoplastic) layers (not shown) are temporarily inserted within slot 75.

With microwave energy being transmitted by magnetron 13 to energy radiating or center wall 20, via transmitting antenna 45 and receiving antenna 21, a magnetic field is produced about center wall 20. This magnetic field produces an electric field about longitudinal slot 75. This electric field causes heat to be established about slot 75 for causing the sealing of the inserted layers of the food container. During this sealing operation, the microwave energy coupled to resonator 11 is substantially dissipated.

It should be recognized that during periods when no package is being heated sealed, the microwave energy in a resonator may be reflected back to the magnetron causing expensive damage thereto.

In accordance with the present invention, resonator 11 is adapted and constructed to function as a transmission line or conduit to direct or couple microwave energy during non-sealing periods to a dummy load 14 to substantially reduce or eliminate damage to magnetron 13 from reflected back microwave energy. During such non-sealing periods, i.e., no package is being inserted within slot 75, center wall 20 functions as a transmission line to conduct microwave energy, introduced into resonator 11 by antenna 21, to transmitting antenna 24. Transmitting antenna 24 then transmits the microwave energy to dummy load 14 which substantially dissipates the not utilized microwave energy.

It is to be understood that the above described embodiment is illustrative of the application of the principles of the present invention. Other arrangements may be devised by those skilled in the art without departing from the spirit and scope of the claimed invention.

We claim:

1. A microwave energy resonator device having particular utility for heating material by microwave energy with being provided microwave energy from a microwave energy source, comprising:
   - elongate housing means having an elongate slot dimensioned for receiving the material to be heated;
   - an elongate center wall mounted within said housing means and having an elongate free edge portion proximate with said slot;
   - first antenna means connected to said center wall for coupling microwave energy from the microwave energy source to said center wall;
   - second antenna means connected to said center wall for transmitting microwave energy outside said housing means,
   - whereby said microwave energy device with being provided microwave energy affects a duals function of an energy resonator and a microwave energy transmission means.

2. A microwave energy resonator device as in claim 1, wherein:
   - the housing means has an elongate rectangular shape formed of metal, and the center wall is integrally formed within said housing means.

3. A microwave energy resonator device as in claim 1, wherein:
   - the first antenna means has a portion coated with plastic; and
   - the second antenna means has a portion coated with plastic.

4. A microwave energy resonator device as in claim 1, wherein:
   - the elongate housing means and the elongate center wall are integrally formed from an elongate piece of aluminum.

5. A microwave energy resonator device as in claim 1, wherein:
   - the housing means and the center wall are integrally formed from a solid metal elongate generally rectangular shaped bar to have an upper wall member, a pair of spaced apart side wall members, a pair of partial bottom wall members with said slot formed therebetween, a first resonator chamber between a respective one of said side wall members and said center wall, a second resonator chamber between the other side wall member and said center wall, said slot extending into said first and second resonator chambers.

6. A microwave energy resonator device as in claim 5, wherein:

the upper wall member has a first and a second spaced antenna receiving hole;

the center wall has a first and a second spaced apart V-shaped notch each being aligned with a respective antenna receiving hole;

the first antenna means is affixed to the first V-shaped notch and has a portion projecting through the first antenna hole; and the second antenna means is affixed to the second V-shaped notch and has a portion projecting through the second antenna hole.

7. A microwave heat applicator device capable of being operatively coupled to a source of microwave energy and a dummy load having particular utility for heat sealing a projecting ledge portion of a food container in a mass production environment with being energized with microwave energy, comprising:

housing means having an elongate rectangular configuration with an elongate slot (75) dimensioned for receiving the projecting ledge portion of the food container, an elongate upper wall member (15) having a first and a second spaced antenna receiving hole (23,27), said housing means having an elongate cavity divided into two chambers (100,101) by an elongate integrally formed center wall (20) with each chamber extending to said slot (75), said center wall having a pair of spaced generally V-shaped notches (22,26) each being aligned with a respective one of said first and second antenna receiving holes (23,27);

receiving antenna means (21) affixed to one of said notches (22) and projecting through said first antenna receiving hole (23) for coupling the microwave energy to said center wall (20);

transmitter antenna means (24) affixed to the other one of said notches (26) and projecting through said second antenna receiving hole (27) for transmitting microwave energy outside said housing means to the dummy load for being substantially terminated by the dummy load;

whereby the microwave heat applicator with being provided microwave energy from the source of microwave energy and having the projecting ledge portion of the foot container being inserted within a portion of said slot (75) effects a heat sealing function to the inserted projecting ledge portion, and during periods without the projecting ledge portion of the foot container being within said slot (75) said center wall (20) also functions as a transmission line means for coupling a portion of the microwave energy being fed to said center wall to said transmitter antenna.

8. A microwave heat applicator as in claim 7, wherein:

the notches (22,26) are each provided approximately at a respective end portion of said center wall.

9. A microwave heat applicator as in claim 8, wherein:

the notches are spaced apart approximately at multiple half wavelengths of the microwave energy.

10. A microwave heat applicator as in claim 7, wherein:

the housing means and the center wall are integrally formed from an elongate piece of metal to have an upper wall member, a pair of spaced side wall members, a pair of partial bottom wall members defining said slot therebetween, a first chamber defined between a respective one of said side wall members and said center wall and a first inner portion of said upper wall member and a first respective one of said partial bottom wall members with said first chamber (100) extending to said slot, a second chamber defined between a respective one of said side wall members and said center wall and a second inner portion of said upper wall member and a second respective one of said partial bottom wall members with said second chamber (101) extending to said slot.

* * * * *